US009868570B2

(12) United States Patent
Ferrari et al.

(10) Patent No.: US 9,868,570 B2
(45) Date of Patent: Jan. 16, 2018

(54) RECLOSABLE STOPPER REVEALING A FIRST OPENING

(71) Applicants: Silvia Ferrari, Lodi (IT); Guglielmo Ferrari, Lodi (IT)

(72) Inventors: Silvia Ferrari, Lodi (IT); Guglielmo Ferrari, Lodi (IT)

( * ) Notice: Subject to any disclaimer, the term of this patent is extended or adjusted under 35 U.S.C. 154(b) by 0 days.

(21) Appl. No.: 15/114,847

(22) PCT Filed: Feb. 20, 2015

(86) PCT No.: PCT/EP2015/000400
§ 371 (c)(1),
(2) Date: Jul. 28, 2016

(87) PCT Pub. No.: WO2015/128071
PCT Pub. Date: Sep. 3, 2015

(65) Prior Publication Data

US 2016/0368674 A1 Dec. 22, 2016

(30) Foreign Application Priority Data

Feb. 28, 2014 (IT) ..... MI2014A0311

(51) Int. Cl.
*B65D 47/08* (2006.01)
*B65D 41/34* (2006.01)
*B65D 55/02* (2006.01)

(52) U.S. Cl.
CPC ..... *B65D 47/0842* (2013.01); *B65D 41/3433* (2013.01); *B65D 47/0804* (2013.01);
(Continued)

(58) Field of Classification Search
CPC ..... B65D 47/0842; B65D 47/0838; B65D 47/0833; B65D 47/0804; B65D 47/08;
(Continued)

(56) References Cited

U.S. PATENT DOCUMENTS 4,821,898 A * 4/1989 Smalley ..... B65D 50/045 215/206
5,875,907 A * 3/1999 Lay ..... B65D 47/0804 215/250

(Continued)

FOREIGN PATENT DOCUMENTS

| | | |
|---|---|---|
| EP | 1174359 | 1/2002 |
| EP | 2084078 | 11/2010 |
| WO | 2009141700 | 11/2009 |
| WO | 2010112801 | 10/2010 |
| WO | 2012118502 | 9/2012 |

*Primary Examiner* — Robert J Hicks
(74) *Attorney, Agent, or Firm* — Themis Law

(57) ABSTRACT

A reclosable stopper for revealing a first opening includes a base body for positioning on a container mouth (12), from which base body a pouring element extends upwardly, and a protection and closing cap integrally and hingedly connected to the base body. The base body also includes a guarantee ring connected by frangible bridges to a collar. The cap is firmly positioned on the base body for closure. A tamper-proof feature is provided between the base body having the pouring element, and the cap, for revealing a first opening, which includes a double frangible connection system which can be actuated towards the inside of the cap.

5 Claims, 3 Drawing Sheets

(52) U.S. Cl.
CPC .... *B65D 55/024* (2013.01); *B65D 2101/0023* (2013.01); *B65D 2101/0069* (2013.01)

(58) Field of Classification Search
CPC ..... B65D 47/06; B65D 55/024; B65D 51/18; B65D 41/3433; B65D 41/3428; B65D 41/3423; B65D 41/34; B65D 41/32; B65D 43/162; B65D 43/164; B65D 43/16; B65D 43/169
USPC ... 220/254.3, 254.1, 259.1, 256.1, 837, 836, 220/810; 215/243, 237, 235, 253, 250; 222/153.1, 545, 562, 568, 567
See application file for complete search history.

(56) References Cited

U.S. PATENT DOCUMENTS

| | | | | |
|---|---|---|---|---|
| 6,269,986 | B1 | 8/2001 | Gross | |
| 8,292,101 | B1 * | 10/2012 | Bragg | B65D 50/046 215/237 |
| 2005/0116382 | A1 * | 6/2005 | Nusbaum | B65D 47/148 264/242 |
| 2005/0205607 | A1 * | 9/2005 | Hierzer | B65D 47/0804 222/153.1 |
| 2008/0011704 | A1 * | 1/2008 | Van Ryn | B65D 47/0814 215/235 |
| 2008/0023477 | A1 * | 1/2008 | Markert | B65D 47/0809 220/259.1 |
| 2013/0119061 | A1 | 5/2013 | Smith | |
| 2014/0224802 | A1 * | 8/2014 | Gonnert | B65D 47/0814 220/265 |

* cited by examiner

Fig. 1
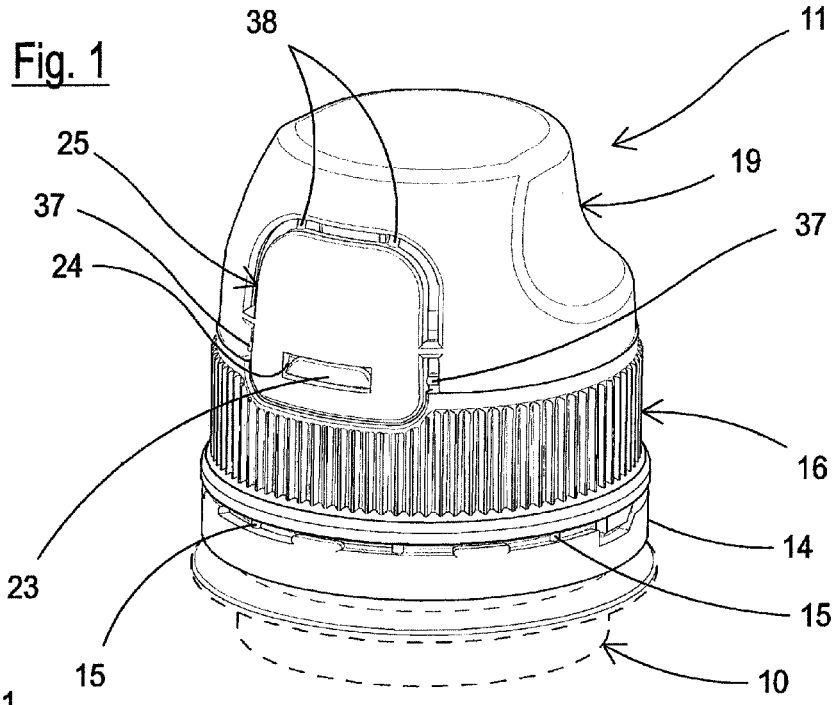
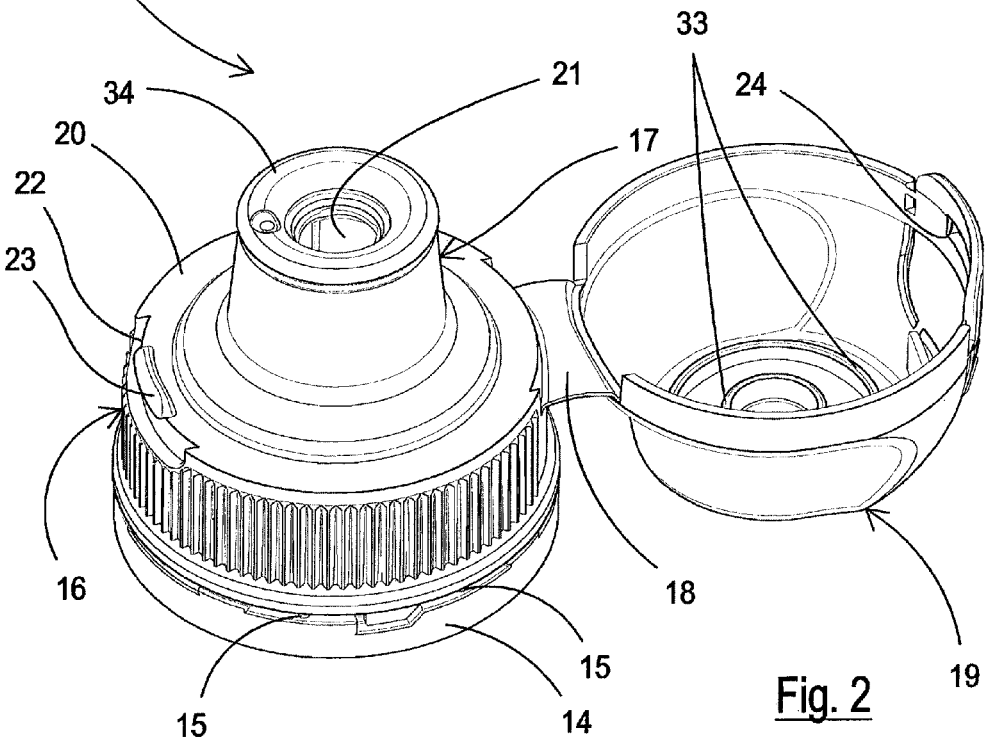
Fig. 2

34
39
33
20
13
12
19
38
17
25
24
23
22
16
14
10
11

IV
IV
11
17
34
33
20
13
12
14
10
23
25
38
30
19
24
37
38
16
15

Fig. 5
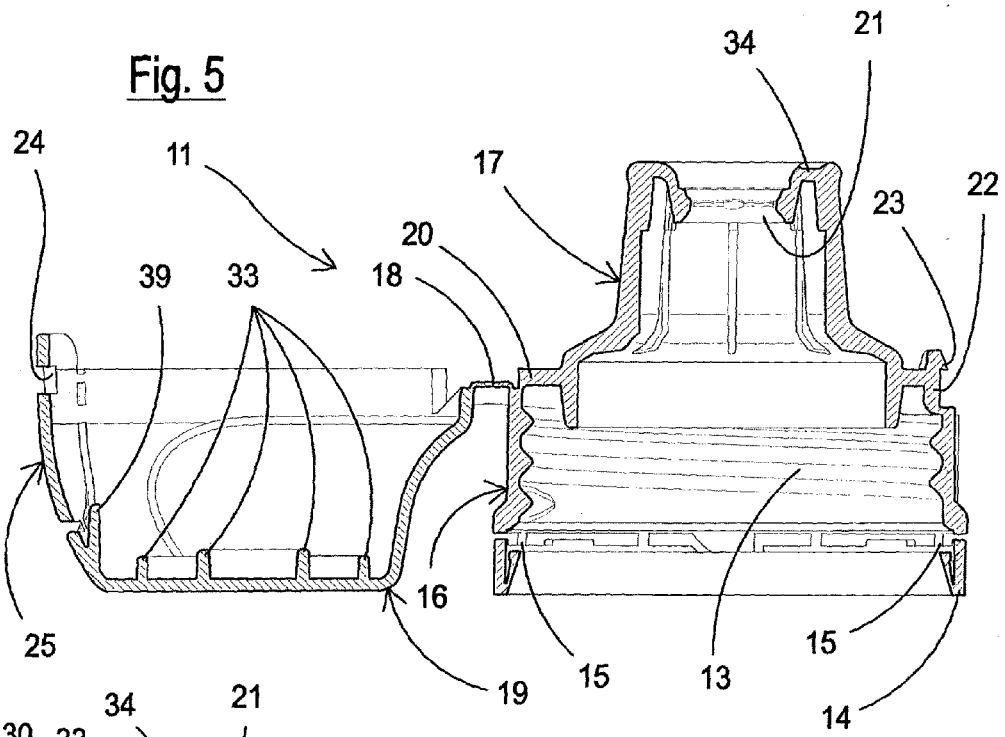
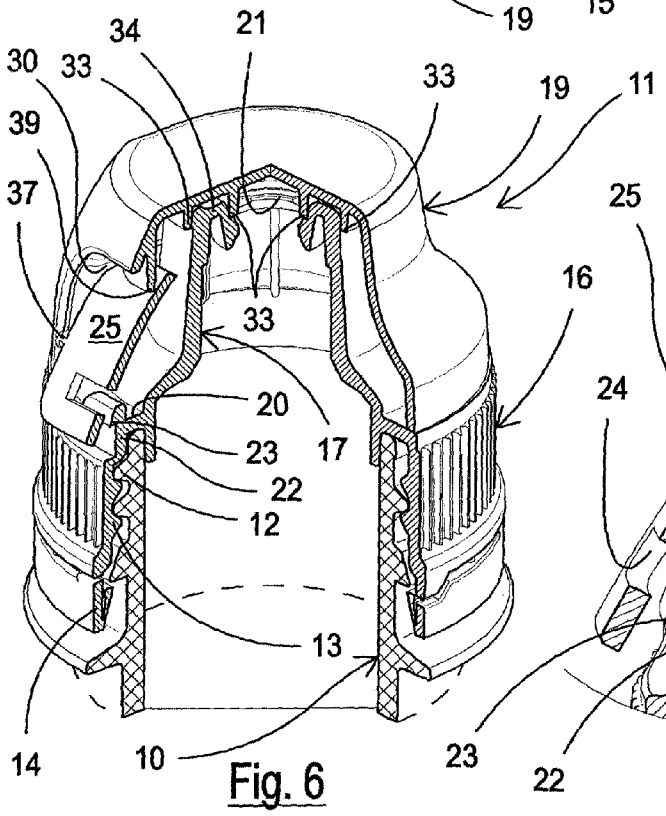
Fig. 6
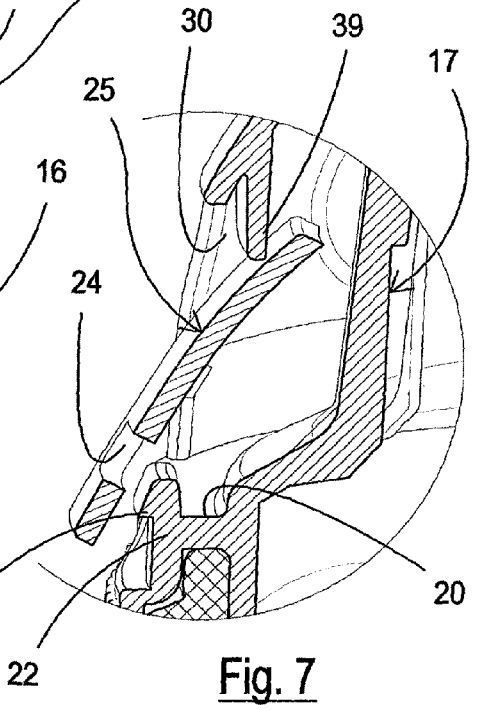
Fig. 7

RECLOSABLE STOPPER REVEALING A FIRST OPENING

FIELD OF THE INVENTION

The present invention relates to a reclosable stopper revealing a first opening.

BACKGROUND OF THE INVENTION

Particular stoppers having specific features are currently used for containers for drinks and other liquid products, such as juices, tea, vitamin supplements, water with additives, etc. These stoppers, in fact, must, on the one hand, be able to be reclosed after the first opening and on the other hand, must be able to show that said first opening has already been effected or that there has been a forced opening.

These stoppers are generally composed of various elements in which specific frangible portions are envisaged, which cannot be integrally reconstituted, showing that the stopper has already been opened. This reveals a possible opening on the part of third-parties who have substituted the product contained in the container with a less expensive and lower-quality product or who have altered the contents.

Once opened, these stoppers must also be able to be reclosed, to allow the product contained in the container to be tasted or consumed by the user in the quantities and with the frequency desired until it has been completely consumed. They must therefore have features of "openable and closeable" stoppers that can be effected with extreme simplicity and precision, with a certain preservation of the contents of the container even after the stopper has been reclosed to maintain the quality of the product.

The user must in fact be guaranteed of the originality of the product and its derivation directly from the sales company in addition to the preservation of its characteristics with time.

Numerous attempts have been made in this respect in recent years for finding a solution to the problem and various systems have been developed which are not capable of solving all of these drawbacks.

There is, however, a continual search for a solution that can provide greater protection of the integrity of the product, that is easy to use and also satisfies the requirements of the user in its simplicity of use.

SUMMARY OF THE INVENTION

A general objective of the present invention is to solve the above drawbacks of the known art in an extremely simple, economical and particularly functional manner.

A further objective of the present invention is to provide a reclosable stopper revealing a first opening with a minimum number of components, which is easy to use for any user adopting it.

Another objective of the present invention is to provide a reclosable stopper which does not have the complexity of construction, at the same time maintaining a good resistance and robustness that allow an easy application.

In view of the above objectives, according to the present invention, a reclosable stopper revealing a first opening has been conceived, having the characteristics specified in the enclosed claims.

BRIEF DESCRIPTION OF THE DRAWINGS

The structural and functional characteristics of the present invention and its advantages with respect to the known art will appear even more evident from the following description, referring to the enclosed drawings, which, inter alia, show a schematization of an exemplificative embodiment of a reclosable stopper revealing a first opening produced according to the same invention. In the drawings:

FIG. 1 shows a schematic and synthetic perspective view of a reclosable stopper revealing a first opening according to the present invention closed on an end section of a container, only partially shown;

FIG. 2 shows a perspective view of the stopper of FIG. 1 alone, open and slightly rotated;

FIG. 5 shows a sectional view of the stopper of FIG. 2 alone, completely open when it has been molded;

FIG. 6 shows a perspective view of the whole stopper positioned on the end section of the container, split into a vertical segmented portion thereof, when the group revealing the first opening is beginning to be opened;

FIG. 7 shows an enlarged view of a detail in a perspective section of the stopper in an area shown in FIG. 6 from a different observation point once it has started to act on the group revealing the first opening of the stopper.

DETAILED DESCRIPTION OF EMBODIMENTS OF THE INVENTION

Figure 4:
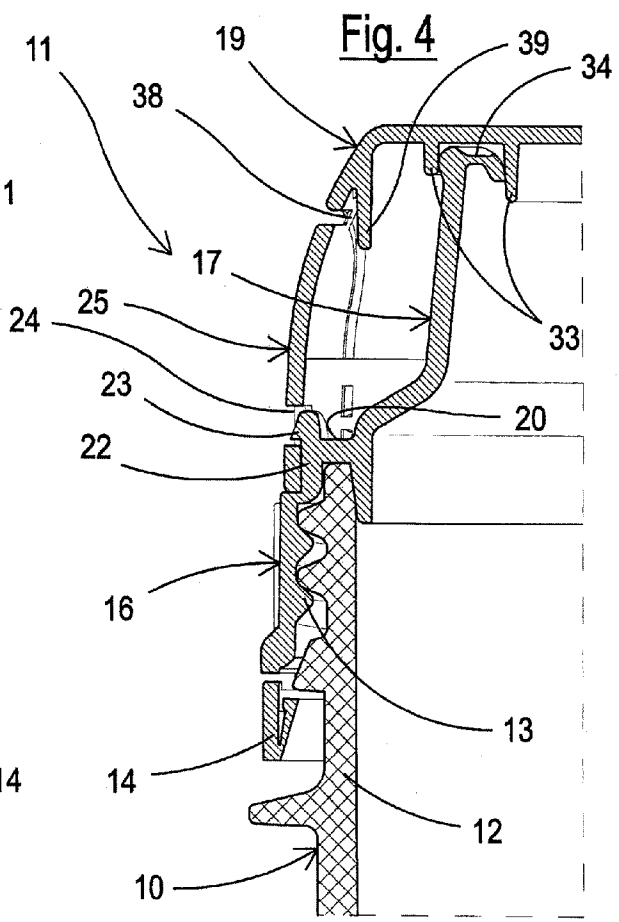
FIG. 4 shows a sectional view of part of a half of the stopper and the end section of the container in correspondence with the centre-line where the line IV-IV in FIG. 3 is indicated.
Figure 3:
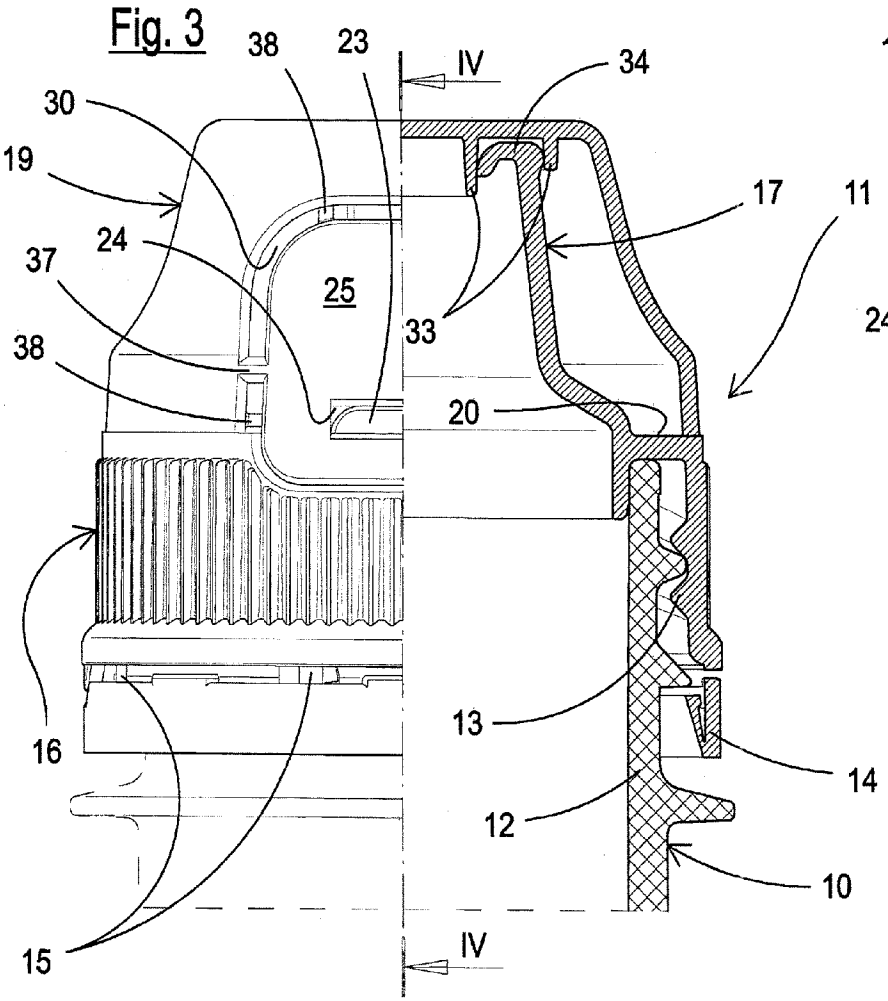
FIG. 3 is a raised, half-sectional view of the stopper and end section of the container of FIG. 1.

With reference to the figures, these illustrate a reclosable stopper revealing a first opening produced according to the invention. The stopper is of the openable and reclosable type and is indicated as a whole with 11.

The stopper 11 is generally positioned on a container shown only by means of a threaded mouth 12 of an end section 10 of the container.

The stopper 11 is generally screwed onto the threaded mouth 12 of the container 10 thanks to the presence of a complementary internal threading 13.

The stopper 11 essentially comprises a base body comprising a guarantee ring 14 connected through frangible bridges 15 to a collar 16 provided in its interior with an internal threading 13. A pouring element or distributor 17 extends from said collar 16, which therefore defines the whole base body, pouring element or distributor which, for example, is brought to the user's mouth.

A connection bridge 18 in the form of a strip, which acts as a hinge, connects the base body to a protection and closing cap 19 suitable for being firmly positioned on the base body.

As already indicated, the whole stopper schematically described is molded in a single piece, in two parts reclosable over each other.

More specifically, the collar 16 comprises in the non-limiting embodiment shown, a radial crown which extends inwardly 20 on which the protection and closing cap 19 is buffered.

The pouring element 17 formed by means of a cylindrically shaped element having a differentiated diameter and ending with a central opening 21 having an upper edge 34, extends upwardly from said annular crown 20.

A group is provided according to the present invention, which reveals a first opening between the base body 16-17 and the protection and closing cap 19.

In order to ensure improved and maximum safety, said group which reveals a first opening between the base body 16-17 and the protection and closing cap 19 comprises a double connection system that can be actuated towards the interior of the stopper, as better illustrated in the description hereunder.

A tooth 22, in fact, positioned on the periphery of the annular crown 20 and provided with a connecting extension 23 which extends radially outwardly, extends upwardly from the annular crown 20 in the same direction as the pouring element 17.

Said extension 23 is such as to be inserted inside a window 24 situated in a flap 25 which is articulately connected inside a housing 30 situated in the protection and closing cap 19.

The articulated connection of the flap 25 in its housing 30 is provided by a pair of cylindrical or differently shaped bridges 37, which interrupt a cavity in the outer wall of the protection and closing cap 19 which defines said housing 30. These bridges 37, are positioned on the opposite side with respect to the flap 25 and act as rotation and connection pins between the protection and closing cap 19 and the flap 25, so as to allow an oscillation of the flap 25 when this is pressed towards the interior of the cap 19.

In one of the upper portions of the flap 25, there is, for example, a pair of frangible bridges 38, which releasably connect it, by breakage of the same, to the housing 30 in the outer wall of the protection and closing cap 19.

Furthermore, as a further characterizing and optional but extremely useful element, a wall extension 39, which extends downwardly inside the protection and closing cap 19, is envisaged inside the protection and closing cap 19, behind the upper part of the housing 30.

More specifically, this wall extension 39 has a limited rigidity and yields slightly when the flap 25 is pushed towards the inside of the protection and closing cap 19.

This flexibility allows the flap 25 to go beyond the wall extension 39 and to be inserted even further inside the protection and closing cap 19.

In this position (shown with a certain precision in FIGS. 6 and 7), the flap 25 is prevented from returning to its initial position, as the wall extension 39 opposes this movement.

Furthermore, another important element lies in the fact that the protection and closing cap 19 comprises two internal coaxial walls which define two cylindrical con-centric lips 33, which extend downwardly inside the cap 19. The two lips 33 are inserted internally inside the opening 21 and externally outside the upper edge 34 of the opening 21.

It should also be pointed out that a stopper according to the present invention can comprise, in correspondence with the opening 21, a specific check valve which prevents the outflow of the product in the case of accidental overturning of the container when the cap is open.

In this non-limiting example, all the most important features forming part of the present invention, can be found.

According to the invention, a stopper is therefore provided, which, although reclosable, reveals the first opening, and envisages a double detection security of possible tampering that has taken place.

When a user is holding a container provided with a stopper according to the invention, he can immediately notice whether the stopper is intact and has never been previously opened.

According to what is described, in fact, if a first opening is effected, the flap 25 is positioned inside the housing 30 and it is very difficult for it to return to its initial position due to the presence of the wall extension 39, which extends downwardly inside the protection and closing cap 19 preventing it from returning.

Consequently, the user first of all verifies and ensures that the stopper is intact by making sure that the frangible bridges 38 which connect the flap 25 to the housing 30 are not broken and that the flap is firmly fixed to the protection and closing cap 19, without being able to oscillate with respect to it.

The user then presses and pushes the upper part of the flap 25 so that the flap 25, which is connected to the housing 30 by means of the bridges 37 on opposite sides to the housing 30, oscillates rotatingly towards the inside of the cap 19.

The pushing of the flap 25 causes breakage of the frangible bridges 38 which connect it in its upper part to the housing 30 of the outer wall of the protection and closing cap 19.

The oscillation towards the interior of the cap on the part of the flap 25 is enabled by the presence of the bridges 37, which are positioned on the opposite side with respect to the flap 25 and act as rotation and connection pins between the protection and closing cap 19 and the flap 25, allowing its oscillation when pressed towards the inside of the cap 19.

The continued pushing of the upper portion of the flap 25 ensures that this goes beyond the wall extension 39, which, as already mentioned, extends downwardly in-side the protection and closing cap 19.

This extension beyond the wall extension 39 prevents the flap 25 from returning to its initial position and reveals the first opening effected.

It is evident that even the mere presence of a breakage of the bridges 38 reveals an opening of the flap 25 and therefore the stopper of the container.

It should also be pointed out that with a stopper according to the present invention, a pressing of the flap 25 also causes a disengagement of the extension 23 of the tooth 22 from the window 24. This allows a free rotation of the cap 19 with respect to the base body to release the pouring element 17.

With the above-mentioned pushing action towards the interior of the cap 19 of the flap 25, a double disengagement of the tooth 22, 23 is therefore obtained with respect to the window 24 and also of the flap 25 with respect to the housing 30, i.e. the breakage of the frangible bridges 38.

It is therefore evident that a possible breakage of the bridges demonstrates an improper opening of the container.

The objective mentioned in the preamble of the description has consequently been achieved.

The protection scope of the present invention is therefore defined by the enclosed claims.

The invention claimed is:

1. A reclosable stopper (11) revealing a first opening, positioned on a threaded mouth (12) of a container (10), comprising:

a base body, from which a pouring element (17) extends upwards;

a protection and closing cap (19) produced integrally in a single piece with the base body and connected to said base body by a connecting bridge (18) shaped as a strip and acting as a hinge, wherein said base body comprises a guarantee ring (14) connected by frangible bridges (15) to a collar (16), the collar having an interior provided with a threading (13) complementary to a threading of the threaded mouth (12), and wherein the protection and closing cap (19) is firmly positioned on the base body for closure, further comprising a group provided between said base body having said pouring element (17), and said protection and closing cap (19), the group including, the first opening defined in the reclosable stopper, the first opening having an edge, a flap disposed within the first opening, a first and a second rotating bridge connecting opposite side edges of the flap with the edge of the opening, the first and the second rotating bridge operating as rotation pins to enable a rotation of the flap within the opening, frangible bridges (38) connecting an upper portion of said flap to the edge of the first opening, and a tooth (22, 23) which extends from said base body and is inserted in a window (24) defined in the flap (25).

2. The reclosable stopper according to claim 1, wherein said collar (16) comprises an annular crown which extends inwardly (20), said protection and closing cap (19) being buffered on said annular crown, and wherein the pouring element (17) is shaped as a cylindrical shaped element having a differentiated diameter and terminating with a central opening (21) having an upper edge (34), and extends upwardly from said annular crown (20).

3. The reclosable stopper according to claim 1, wherein said protection and closing cap (19) comprises two cylindrical concentric lips (33), which extend downwards inside the protection and closing cap (19), said lips being inserted internally inside an opening (21) of said pouring element (17) and externally outside an upper edge (34) of the opening (21).

4. The reclosable stopper according to claim 1, further comprising a wall extension (39) disposed inside the protection and closing cap (19), behind an upper part of said edge of said first opening, and extending downwardly inside the protection and closing cap (19).

5. The reclosable stopper according to claim 4, wherein said wall extension (39) has a limited rigidity and yields when said flap (25) is pushed towards an inside of the protection and closing cap (19) so that an upper edge of said flap (25) extends beyond said wall extension (39) and becomes inserted even further inside the protection and closing cap (19), causing said wall extension to become interposed between the upper edge of the flap and an outside environment and preventing a backward rotation of said flap.

* * * * *